US005336403A

United States Patent [19]

Marbach

[11] Patent Number: 5,336,403

[45] Date of Patent: Aug. 9, 1994

[54] SUBMERSIBLE SWIMMING POOL CLEANER

[75] Inventor: Gerard Marbach, Buhl, France

[73] Assignee: Sevylor International, SA, Buhl, France

[21] Appl. No.: 140,413

[22] Filed: Oct. 25, 1993

[51] Int. Cl.[5] ..... E04H 3/20

[52] U.S. Cl. ..... 210/169; 15/1.7; 210/241

[58] Field of Search ..... 210/169, 416.2, 241, 210/220; 15/1.7

[56] References Cited

U.S. PATENT DOCUMENTS

| | | | |
|---|---|---|---|
| 2,725,356 | 11/1955 | Lombardi | 210/169 |
| 3,063,077 | 11/1962 | Pansini | 210/169 |
| 3,245,420 | 4/1966 | Cherney | 15/1.7 |
| 3,287,755 | 11/1966 | Pansini | 15/1.7 |
| 3,444,575 | 5/1969 | Martin | 15/1.7 |
| 3,932,281 | 1/1976 | Pansini | 15/1.7 |
| 3,961,393 | 6/1976 | Pansini | 15/1.7 |
| 5,099,535 | 3/1992 | Chauvier et al. | 15/1.7 |

*Primary Examiner*—Peter A. Hruskoci
*Assistant Examiner*—Robert J. Popovics
*Attorney, Agent, or Firm*—Birch, Stewart, Kolasch & Birch

[57] ABSTRACT

A submersible swimming pool cleaner including a wheeled housing into which an intake fitting for the intake of pressurized water is disposed, and an angularly disposed manifold member inside of the housing containing a plurality of apertures through which the pressurized water is directed at an angle against the pool bottom. A pair of wheel members are positioned at a front of the housing to facilitate transport of the apparatus across the pool bottom and to provide a clearance between the leading edge of the housing and the pool bottom through which debris may enter into a cavity of the housing. The housing further includes a wiper blade secured to the housing rearwardly of the manifold and positioned to seal and direct water along the pool bottom when the apparatus is in operation and thereby further loosen debris from the pool bottom. A debris collection bag is fixed over an exhaust aperture in the rear of the housing for collecting debris.

7 Claims, 3 Drawing Sheets

SUBMERSIBLE SWIMMING POOL CLEANER

BACKGROUND OF THE INVENTION

1. Field of the Invention

The present invention relates to a manually guided, submersible cleaner for a swimming pool bottom having a wheeled housing.

2. Description of Related Art

Heretofore, a number of submersible pool cleaners have been developed which utilize pressurized water to loosen debris from the pool floor. Exemplary of such a cleaner is that described in U.S. Pat. No. 4,994,178 to Brooks, issued on Feb. 19, 1991. In the Brooks cleaner, a mesh debris collecting bag 22 is connected to the rectangular pool cleaning implement 12. A forked connector 28 joins the rectangular frame to a water nozzle fitting 42 at the end of a conduit 44 coupled to a source of water under pressure. As the implement is pulled over the floor of the pool, water jets issuing from fitting 42 direct debris into the bag 22 while the leading edge of the rectangular frame scrapes additional debris from the floor of the pool.

Other examples of submersible pool cleaners utilizing water under pressure to loosen debris from the pool floor can be found in U.S. Pat. No. 4,776,954 to Brooks, issued Oct. 11, 1988; U.S. Pat. No. 4,040,864 to Steeves, issued Aug. 9, 1977; U.S. Pat. No. 3,444,575 to Martin, issued May 20, 1969; and U.S. Pat. No. 3,287,755 to Pansini, issued Nov. 29, 1966.

All of the above mentioned submersible swimming pool cleaners utilize a pressurized jet as an incidental means of removing debris from the pool bottom during operation of the apparatus. In none of these cleaners are the force and agitation properties of the pressurized water modified to provide enhanced debris removing capabilities of the cleaner. Moreover, in none of the present cleaners is the pressurized water jet directed at the pool bottom and utilized in conjunction with a scraping or water sealing member in such a manner as to optimally remove debris from the pool bottom.

SUMMARY OF THE INVENTION

Accordingly, it is a primary object of the present invention to provide a submersible pool cleaning device which utilizes a plurality of pressurized high velocity water jets directed downwardly and rearwardly within a cavity of a housing to loosen debris from a pool bottom for collection in a debris bag attached to a rear of the housing.

It is a further object of the present invention to provide a submersible pool cleaner with a wiper blade disposed to the rear of the high velocity water jets, and angled downwardly and forwardly to seal off the bottom during operation of the cleaner, to sweep and provide a direction for loosening debris from the pool bottom for collection in a collection bag attached to the rear of the cleaner housing.

The objects of the present invention are fulfilled by providing an apparatus for submersibly cleaning a pool bottom comprising: a rectangular housing with wheels located at the corners of a front of the housing for assisting in the transportation of the apparatus across the pool bottom, said wheels being positioned to create a clearance between the leading or front edge of the apparatus and the pool bottom to allow for the passage of debris into the center cavity of the housing, a downwardly and forwardly angled wiper blade located behind the wheels for sealing debris within the housing during operation of the apparatus, a water inlet fitting through which water under pressure enters the housing, an outlet manifold or other means containing a plurality of apertures through which the pressurized water velocity is increased and directed downwardly and rearwardly into the central cavity of the housing and onto the pool floor in a plurality of jets, thereby enhancing the speed and concomitant agitation capability of the jets to loosen debris from the pool bottom, a collection bag connected to the downstream opening of a chute defined by a rear end of the housing, a hermetically sealed ballast chamber filled with sand for weighting and balancing the housing, brushes with downwardly extending bristles attached to both sides of the housing to retain debris in the central cavity for ultimate collection in the collection bag, and a handle attached to the cleaner housing for operation of the cleaner from outside of the pool.

In operation, pressurized water passes by means of an attached hose from the pool filtration system through the inlet fitting of the submerged cleaner and into the housing. The water velocity is further increased and directed at an angle through a plurality of evenly spaced-apart holes in the manifold against the pool floor. The high velocity water jets work in conjunction with the wiper blade to contain and direct debris loosened from the pool bottom. The debris, loosened by the high velocity jets and directional wiper blade, is then collected in the mesh collection bag attached to the aperture at the rear of the housing, and the water which carries the debris into the bag passes through the mesh and back into the pool.

Further scope and applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The objects of the present invention and the attendant advantages thereof will become more readily apparent by reference to the accompanying drawings wherein.

DETAILED DESCRIPTION OF PREFERRED EMBODIMENTS

Figure 1:
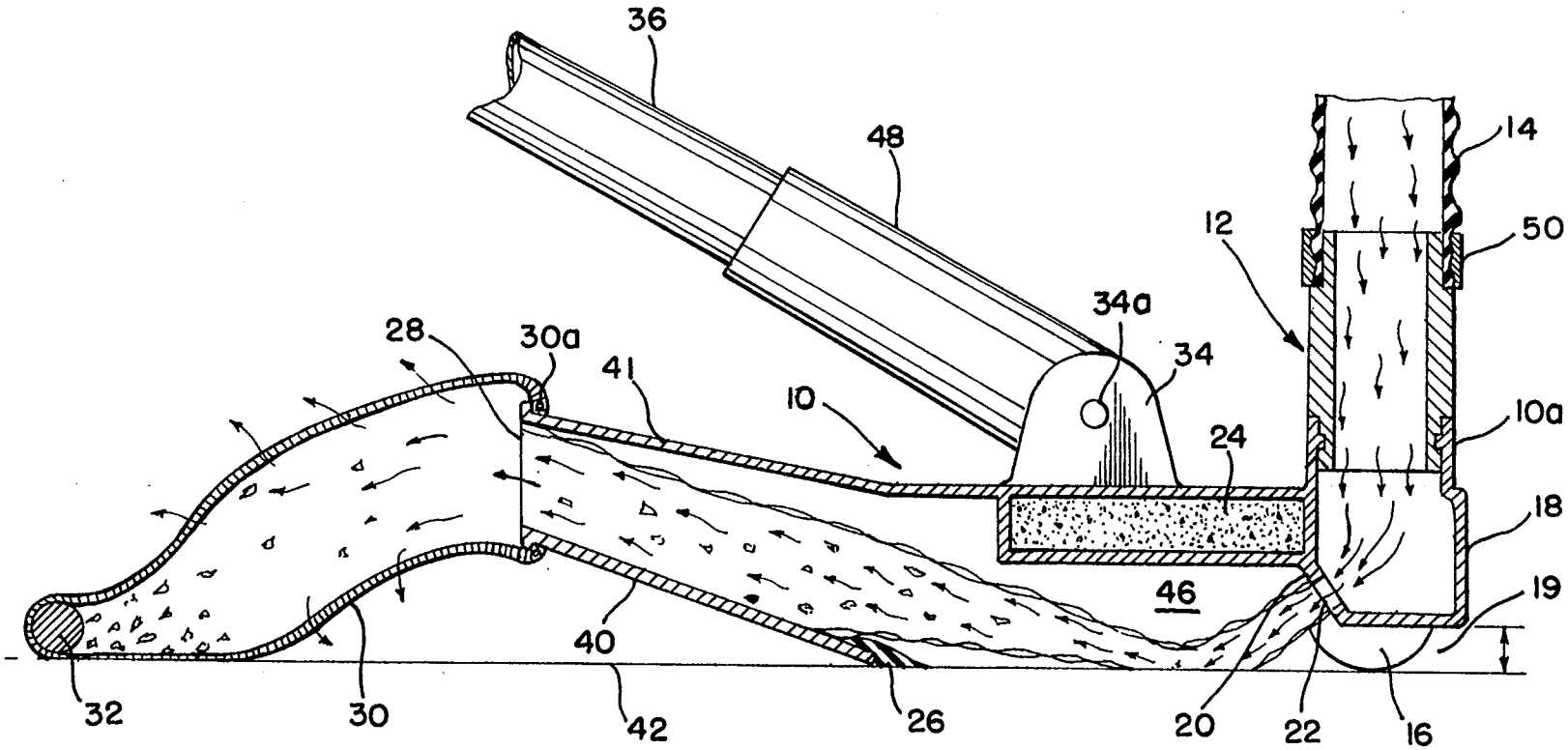
FIG. 1 is a side view showing a submersible pool cleaner in accordance with the present invention.

Referring to FIG. 1, there is generally illustrated a submersible pool cleaner including a housing 10 having an intake fitting 12 which is capable of swiveling with respect to an inlet 10*a* of the housing 10 by means of a known swivel joint. The housing includes a central cavity 46 therein through which debris and propelled water pass. A hose 14 is coupled to the intake fitting 12 by a hose clamp 50 or the like for the intake of pressurized water from the pool filtration system (not shown).

Connected at a front end 18 of the housing 10 are a pair of wheel members 16 which assist in the movement of the apparatus across a pool bottom 42 during use. The wheel members 16 are positioned to allow a sufficient clearance 19 for debris to pass underneath the front end 18 of the housing during operation of the cleaner. The clearance 19 between the leading edge of the housing 10 and the pool floor is preferably about 0.7 inches to allow for optimal operation of the cleaner. The wheels 16 are shown spaced apart at opposing sides of the housing, but may be in any intermediate position therebetween as long as the pair of wheels sufficiently support the housing for smooth transport thereof.

Figure 3:
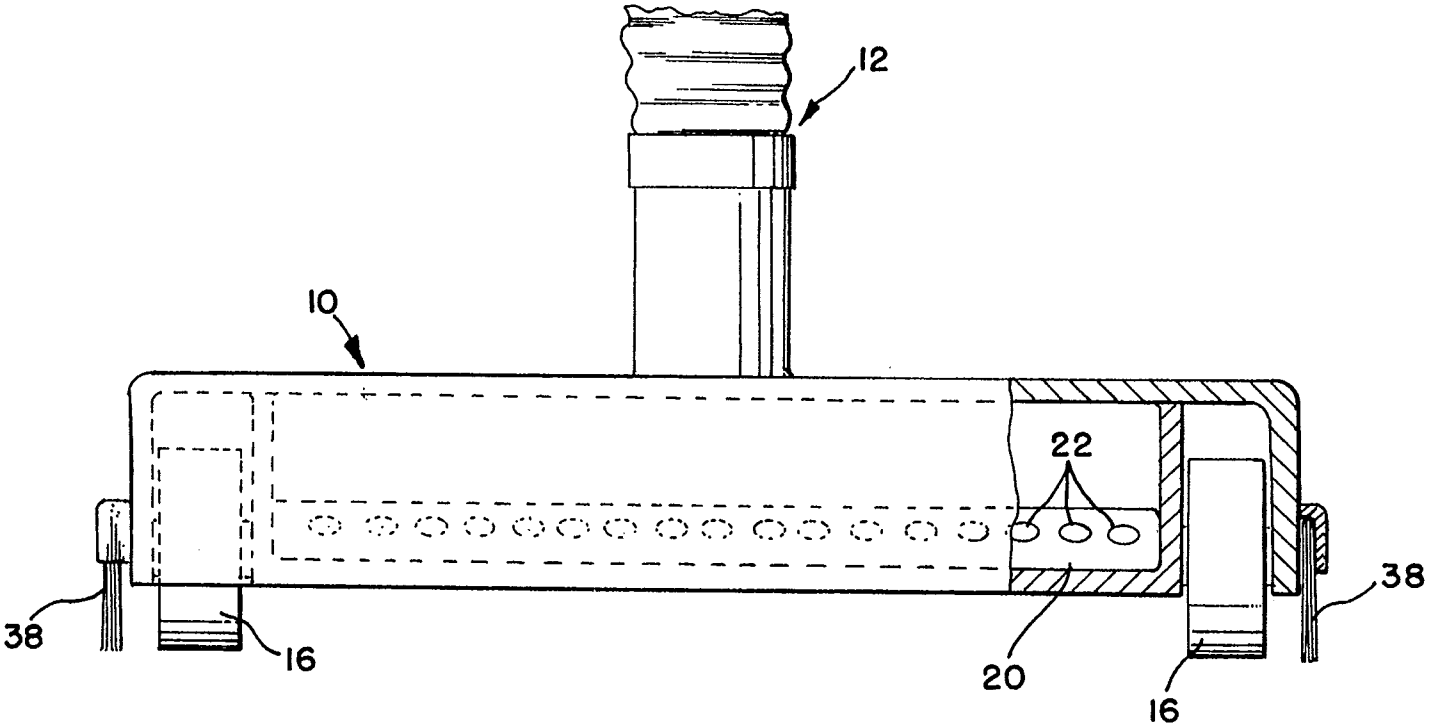
FIG. 3 is a sectional view taken along lines 3—3 in FIG. 2.

A manifold 20 containing a plurality of spaced-apart apertures 22 across a face thereof as shown in FIG. 3 is disposed at an angle within the housing 10 across substantially the entire width of the housing such that the pressurized water received through hose 14 and intake fitting 12 passes through the manifold apertures 22 and is directed at an angle against the pool bottom. The manifold preferably contains in the range of 15 to 30 apertures of a diameter in the range of 0.1 to 0.25 inches. The spacing between the apertures 22 is preferably in the range of between 0.2 to 0.35 inches from center of the aperture to center of the adjacent aperture. The manifold 20 is angled in the range of between 15 to 80 degrees measured at an angle from perpendicular in relation to the pool bottom 42, such that the high pressure water passing therethrough strikes the pool bottom at a like angle. A further increase in velocity is created by forcing the pressurized water through the plurality of smaller apertures 22 in the manifold thereby increasing the force with which the water strikes the pool bottom and thus enhancing the agitating and debris-lifting capability of the apparatus, thereby improving its cleaning ability.

A wiper blade 26 is fixed to a bottom rear cover 40 of the housing 10 in a downward and forward angle (toward the manifold) for engagement with the pool bottom 42 during operation of the cleaner to direct debris loosened from the pool bottom and seal the same within the housing cavity. The wiper blade is preferably made of a strong, but flexible material such as a hard rubber or a crayton material in order to conform to the pool bottom yet maintain a sealing ability. The spacing between the manifold 20 and the wiper blade 26 is preferably in the range of from about 2.5 to 3.0 inches. Referring further to FIG. 1, the bottom rear cover 40 of the housing 10 is fixed or snap fit to the lower half of the housing at a rear thereof. The bottom rear cover 40 is angled upward and away from the pool bottom 42 at an angle of about 20 degrees. The wiper blade 26 is attached to the portion of the rear cover 40 which is adjacent to the pool bottom such that virtually the entirety of the apparatus is supported by the combination of the wheels 16 and the bottom edge of the rear cover 40 with the wiper blade 26. In general, the rear portion of the housing 10 including the bottom rear cover 40 and an upper rear portion 41 of the housing 10 is tapered to a width smaller than a remaining width of the housing. This taper may preferably be at about 12 degrees rearward from a main portion of the housing.

The housing 10 further contains an exhaust aperture 28 through which the loosened debris is expelled during operation of the cleaner.

A collection bag 30 is attached to the housing at exhaust aperture 28 for collection of the debris lifted from the pool bottom. The collection bag 30 may contain a weight 32 to prevent the bag from floating during operation of the cleaner and potentially causing redirection of the debris back through the aperture 28. The collection bag further includes means for attaching the same to the exhaust aperture such as tie string **30*a* shown in FIG. 2**.

A hermetically sealed ballast chamber 24 containing sand or other material is disposed in the interior of and adjacent a surface of the housing 10 to lend weight and assist in keeping the cleaner in contact with the pool bottom during operation.

A handle mounting member 34 is disposed atop the housing 10 for pivotally receiving a handle support 48 through pivot pin **34*a* for bi-directional operation of the cleaner from outside of the pool. An extension of the handle support 48 is achieved with the use of a telescoping or extendable handle member 36** attached to the handle support.

Figure 2:
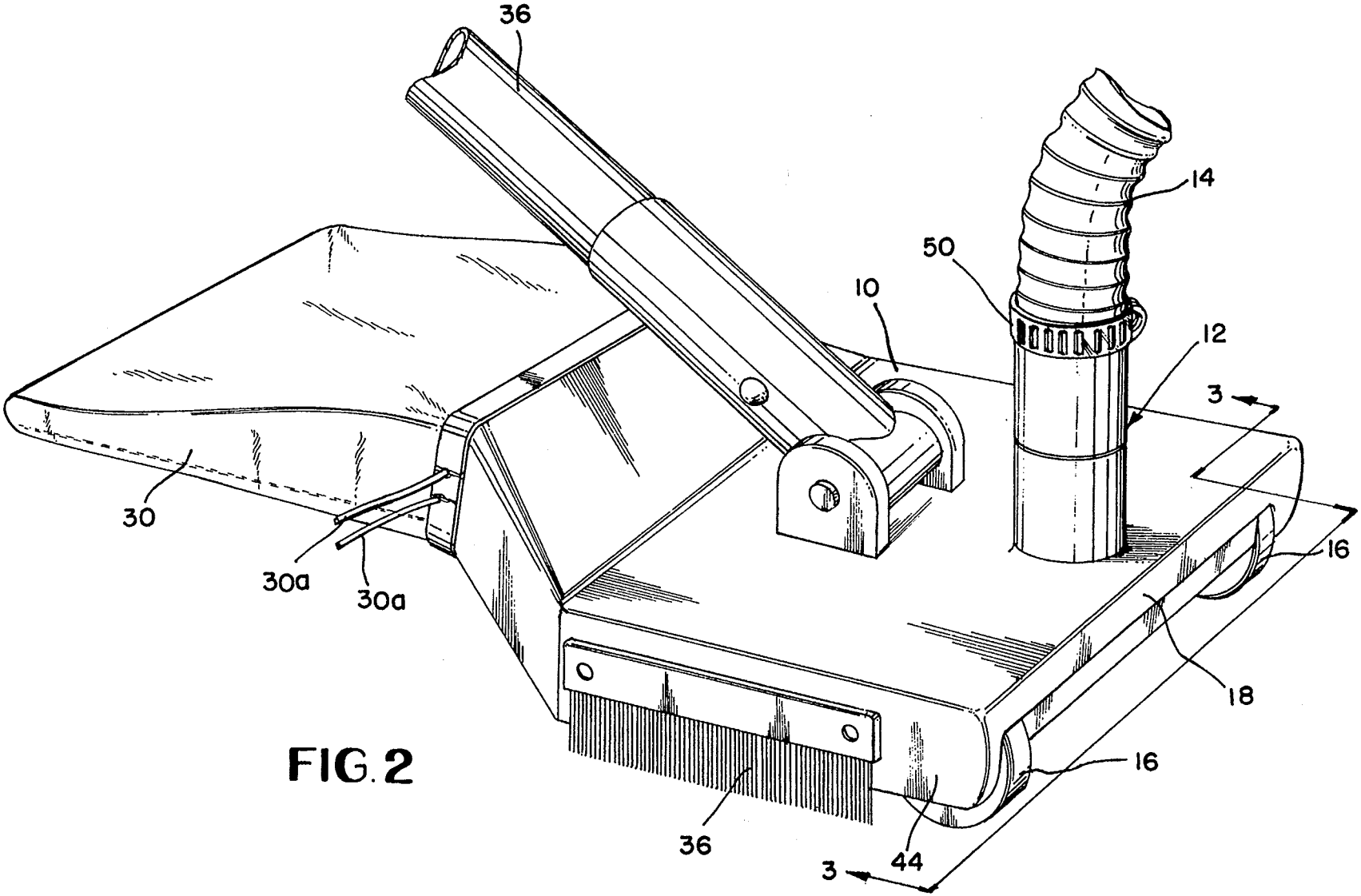
FIG. 2 is a perspective view of a submersible pool cleaner of the type illustrated in FIG. 1 showing the exterior of the cleaner housing.

As shown in FIG. 2, a brush 38 is secured along at least a portion of sides 44 of the housing 10 to keep the loosened debris from escaping under the sides of the housing during operation of the cleaner. Each brush may be approximately 4 inches in length and of a height to be easily mounted to the side of the housing with bottoms of the bristles brushing the pool bottom.

Referring now in particular to FIG. 3, the manifold 20 is disposed within the housing 10 across substantially the entire width of the housing. The manifold contains a plurality of apertures 22 through which pressurized is water received and passed into the housing 10 through the intake fitting 12. The high velocity water is thus directed onto the pool floor 42.

Wheel members 16 facilitate movement of the apparatus across the pool floor and are positioned to create space between the leading edge of the housing and the pool floor for debris to pass into the central cavity 46 of the housing.

In operation, pressurized water which passes by means of an attached hose from the pool filtration system through the inlet fitting of the submerged cleaner and into the housing. The water is further pressurized into high velocity streams and directed at an angle through a plurality of evenly spaced-apart holes in the manifold against the pool floor. The high velocity water jets work in conjunction with the wiper blade to direct debris loosened from the pool bottom. The debris, loosened by the high velocity jets and directed by the wiper blade, is then collected in the mesh collection bag attached to the aperture at the rear of the housing, and the water which carries the debris into the bag passes through the mesh and back into the pool.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for submersibly cleaning a swimming pool bottom comprising:

a housing having front, side and rear walls and a closed top portion;

an intake fitting, disposed in the closed top portion of said housing for delivering pressurized water into the housing;

manifold means, disposed within the housing, for constricting the pressurized water into a plurality of water jets;

said manifold means being angularly positioned within the housing to direct the plurality of water jets onto the pool bottom at a downward and rearward angle;

a wiper blade mounted on said manifold at a portion thereof adjacent the pool bottom for sealing and directing debris on the pool bottom during operation of the apparatus;

an exhaust aperture formed at a rear of the housing for exhausting debris from a cavity of the housing;

a collection bag attached to the rear of the housing over the exhaust aperture for the collection of loosened debris;

a pair of wheel members positioned at the front end of the housing for transport of the housing across the pool bottom;

said wheel members being positioned to create a space between the leading edge of the housing and the pool bottom to allow debris to pass into the central cavity of the housing; and a sealed ballast chamber disposed within the housing for balancing and weighting said housing.

2. The submersible pool cleaner according to claim 1, wherein the wheel members are positioned such that a clearance between the front edge of the housing and the pool bottom is in the range of from 0.3 to 0.45 inches.

3. The submersible pool cleaner according to claim 1, wherein said manifold means contains a plurality of apertures having diameters in the range of from 0.1 to 0.2 inches;

a distance between said apertures being in the range of from 0.2 to 0.3 inches.

4. The submersible pool according to claim 1, wherein said manifold means is disposed within the housing at a rearward angle of between 15 and 80 degrees from a line perpendicular to the pool bottom.

5. The submersible pool cleaner according to claim 1, wherein the distance between said manifold means and the wiper blade is in the range of from 2 to 3 inches.

6. The submersible pool cleaner according to claim 1, wherein the sealed ballast chamber is disposed outside of the housing.

7. The submersible pool cleaner according to claim 1, further including at least one brush is attached to each of opposing sides of said housing.

* * * * *